US006099378A

United States Patent [19]

George et al.

[11] Patent Number: 6,099,378

[45] Date of Patent: *Aug. 8, 2000

[54] REALISTIC DOLL HEAD SYSTEM AND METHOD THEREFOR

[75] Inventors: Richard L. George, Englewood; Reed N. Wilcox, Littleton; W. Kenn Thiess, Aurora; Lane Anderson, Englewood, all of Colo.

[73] Assignee: The Lifelike Company, Englewood, Colo.

[ * ] Notice: This patent is subject to a terminal disclaimer.

[21] Appl. No.: 09/256,795

[22] Filed: Feb. 24, 1999

Related U.S. Application Data

[63] Continuation of application No. 08/732,639, Oct. 16, 1996.
[60] Provisional application No. 60/006,015, Oct. 23, 1995.

[51] Int. Cl.[7] ..... A63H 3/36
[52] U.S. Cl. ..... 446/391; 446/268; 446/372
[58] Field of Search ..... 446/100, 268, 446/369, 372, 391, 392, 394

[56] References Cited

U.S. PATENT DOCUMENTS

| | | |
|---|---|---|
| 4,294,634 | 10/1981 | Mookil . |
| 4,629,442 | 12/1986 | Samo . |
| 4,648,188 | 3/1987 | Blair . |
| 4,659,319 | 4/1987 | Blair . |
| 4,795,397 | 1/1989 | Stevens . |
| 4,892,501 | 1/1990 | Girelli . |
| 4,993,987 | 2/1991 | Hull et al. . |
| 5,004,442 | 4/1991 | Lemelson et al. . |
| 5,009,626 | 4/1991 | Katz . |
| 5,090,910 | 2/1992 | Narlo . |
| 5,314,370 | 5/1994 | Flint . |

OTHER PUBLICATIONS

My Twinn Dolls Catalog (w/order form).
Pleasant Company Holiday 1995 catalog, pp. 64–65.
Videotape of TV commercial for Playmates "Baby So Beautiful", Aug. 21, 1995 (copy supplied with Parent file).

*Primary Examiner*—Robert A. Hafer
*Assistant Examiner*—Jeffrey D. Carlson
*Attorney, Agent, or Firm*—Dorr, Carson, Sloan & Birney, P.C.

[57] ABSTRACT

The present invention provides a system and method for producing realistic doll heads that have the facial appearance of particular children. The customer, using ten facial characteristics set forth in a chart, selects from among a predetermined number of facial characteristics those most closely resembling the facial appearance of the child. The facial characteristics that are selected comprise seven face shapes (rounded, oval, pear, rectangular, thinner rectangular, thinner heart, and wider heart); skin tone; eye color; eyelash color; eyebrow color, thickness, and shape; hair color, cut, length, and style; and birthmarks, moles, and/or freckles. The selected characteristics are then applied to the doll head to produce a one-of-a-kind doll closely resembling the child.

2 Claims, 4 Drawing Sheets

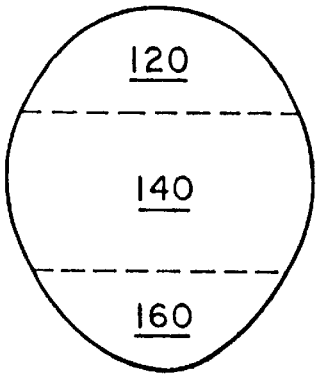
Fig. 1a
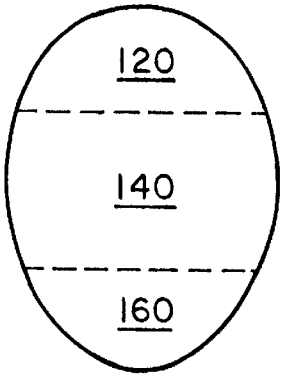
Fig. 1b
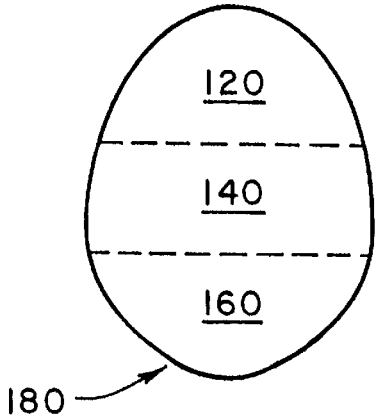
Fig. 1c
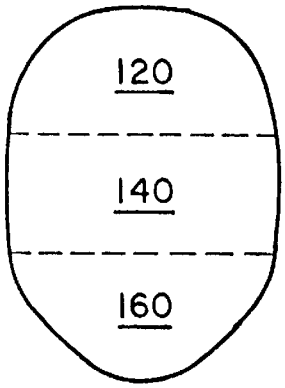
Fig. 1d
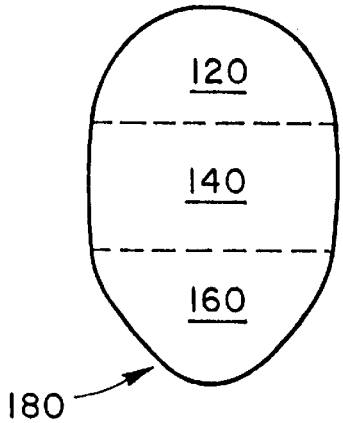
Fig. 1e
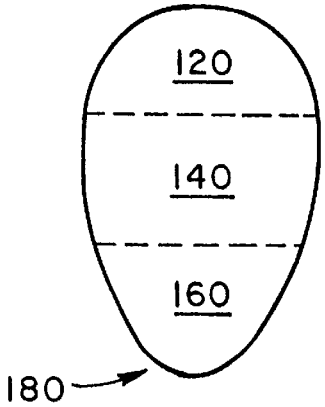
Fig. 1f
Fig. 1g
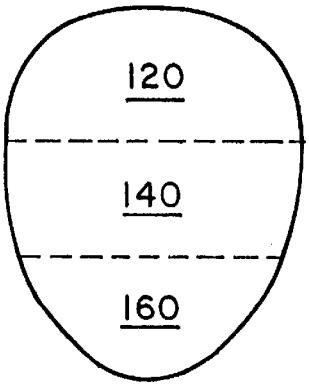

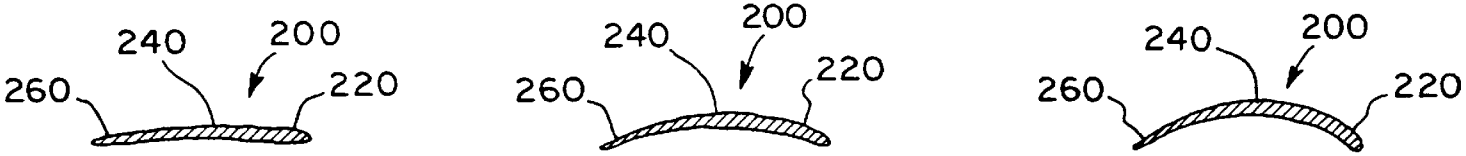
Fig. 2a
Fig. 2b
Fig. 2c
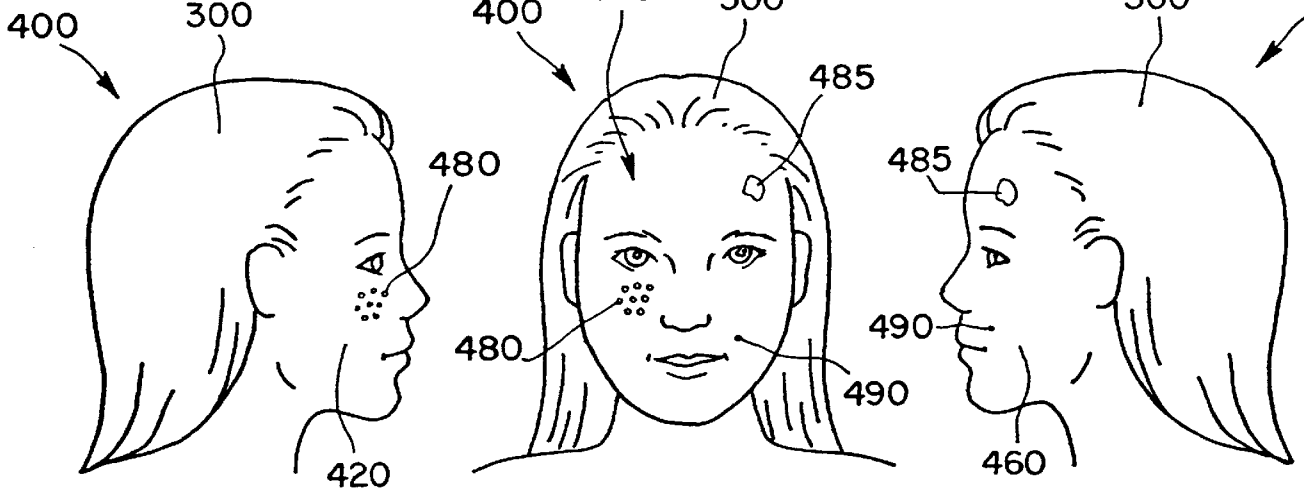
Fig. 4a
Fig. 4b
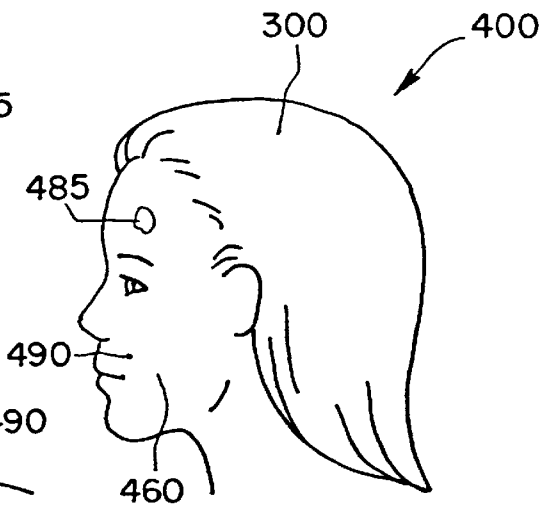
Fig. 4c

REALISTIC DOLL HEAD SYSTEM AND METHOD THEREFOR

RELATED APPLICATION

This application is a continuation of applicant's U.S. patent application Ser. No. 08/732,639 filed Oct. 16, 1996 pending, entitled REALISTIC DOLL HEAD SYSTEM AND METHOD THEREFOR and Provisional Application No. 60/006,015 filed Oct. 23, 1995.

BACKGROUND OF THE INVENTION

1. Field of the Invention

The present invention relates, in general, to dolls, and, more particularly, to an ordering and manufacturing system for manufacturing doll heads that have realistic faces closely matching those of particular children.

2. Statement of the Problem

Dolls have been in existence for time immemorial. At one end of the spectrum are those unique dolls that are so highly crafted, typically with ceramic heads, that they are truly sculpted and painted to be lifelike and corresponding to a particular human's image. Such dolls can range in price from several hundred dollars to several thousand dollars. Each doll is an individual work of art. At the other end of the spectrum are the mass-produced dolls having a typical and perhaps generic doll face usually made of a vinyl or plastic material. Such mass-manufactured dolls are inexpensive, usually costing well less than one hundred dollars.

Many parents desire to have a doll that closely resembles their child, yet are unable to afford the extremely expensive cost of having a doll made by hand by an artist or dollmaker. A need exists in the marketplace to have a high quality doll head closely matching the features and characteristics of a child's face yet that can be produced at a price closer to that of the mass-produced "baby-faced" dolls than to that of the unique, finely sculpted dolls.

A patentability search for systems and methods of manufacturing realistic doll heads resulted in the following patents:

U.S. Pat. No. 4,795,397 issued to Stevens teaches creating a doll that is a "twin" for a child. Stevens discloses a method of making a doll simulating a particular newborn child wherein the weight of the doll exactly matches that of the child, the length of the doll exactly matches that of the child, and at least the handprints or footprints are imprinted onto the doll.

U.S. Pat. No. 4,993,987 issued to Hull et al. pertains to creating a doll having a personalized, photographic face imprinted on the doll head. The doll is made by the steps of (a) taking a photograph of the face of the person, (b) constructing a doll with a blank face made of material impregnable by heat-cured inks in a photographic printing process, and (c) printing the photograph with heat-cured inks on the face of the doll.

U.S. Pat. No. 5,009,626 issued to Katz is a computerized process of creating a three-dimensional lifelike representation of the head portion of a person on a doll. A video image of the head of a person is sent to a computer, which digitizes the image and conforms it to a three-dimensional substrate structure that matches the head of the subject. The image of the person's head is printed on a flexible sheet fabric material in the form of a "azimuthal-type group of connected sector photographic projections." This is illustrated in FIGS. 2–4 showing the printouts of the flat photographic imagery derived from a photograph and transformed into a printout image for fixation to the doll's head. The imprinted flexible material is then applied to the three-dimensional substrate substance. This represents a more precise and unique approach.

U.S. Pat. No. 5,314,370 issued to Flint also provides a process for producing a doll having the face of a person. The '370 patent provides a doll having a head with a three-dimensional facial area, posing a person in front of a color video camera, aligning the person's face in the camera with lateral and up and down boundary markers, transferring the signal from the camera to a color transfer printer using a wax layer to transfer the representation of the face onto a layer of fabric, and trimming and securing the fabric to the facial area of the doll. Again, this represents a precise approach.

U.S. Pat. Nos. 4,648,188 and 4,659,319 issued to Blair provide a system for producing three-dimensional sculptures using a photograph or picture as a guide. The method discloses the steps of providing a photograph, removing the backing from the photograph, producing a picture of the photograph on a pliable film, mounting the pliable film onto a pliable mass of material, manipulating the pliable mass through the picture of the photograph that is on the pliable film, subjecting the manipulated sculpture mass to a hardening process, placing the photograph with the backing removed into plastic by a lamination process, and placing the hardened material into a "Vacu-form" machine so as to place the laminated photograph onto the sculpture.

U.S. Pat. No. 4,892,501 issued to Girelli sets forth a method of fabrication for a doll's head.

U.S. Pat. No. 5,004,442 issued to Lemelson et al. pertains to a series of dolls representing various ages of the same person. The head is shaped, configured, and decorated to represent the same living being at different ages.

At least three commercially available products provide a doll bearing a resemblance to a child. The Pleasant Company, 8400 Fairway Place, Middleton, Wis. 53562, in its "Holiday 1995 The American Girls Collection" offers 20 separate pre-manufactured dolls of varying skin tone, hair color, and eye color, and hair styles. The American Girl dolls are mass or pre-manufactured in large quantities for inventory and retail sales. Each face in the collection of 20 dolls has the same basic shape, with 3 of the 20 dolls having different-shaped eyes and noses based on racial characteristics. The choice is limited to the 20 pre-manufactured dolls displayed. The consumer looks at photographs of the 20 dolls and selects the one with coloring closest to that of their child.

A second commercially available product is BABY SO BEAUTIFUL, manufactured by Playmates. These dolls are also mass or pre-manufactured in large quantities for inventory and retail sales. A television commercial shows a range of 12 to 16 pre-manufactured dolls in which the skin tone, eye color, and hair color and style vary; however, the faces of the dolls appear to be identical.

In a third commercially available product, trademarked MY TWINN by MY TWINN, 31129 Via Colinas, #702, West Lake Village, Calif. 91361, a more customized approach to matching the features and characteristics of a doll head to a child is obtained. For this product, the consumer selects from seven different eye colors, four different skin colors, and ten different hair colors to produce a doll head more closely matching the hair color, hair style, eye color, and skin color of the child, even including the addition of freckles. A photograph of the child is also provided to enable an artist to individually add features to the doll head to more closely match the doll head to the child. The MY TWINN doll, as with the American Girl doll and the Baby So Beautiful doll, also uses a single doll head that has been modified to have Caucasian, African-American, or Oriental nose, eye, and lip features. The MY TWINN doll by offering greater selection at the point of purchase provides 16,800 combinations (7 eye colors×4 skin tones×10 hair colors×10 hair styles×6 hair lengths=16,800) to more closely match the appearance of the doll head to the appearance of the child on a mass production basis. The addition of freckles is not included in the aforesaid calculation.

A need, however, exists to provide an ordering and manufacturing system for producing doll heads, a system that produces a unique doll head that much more closely matches the appearance of the child, without going to the expense of sculpting the doll head, or using any of the high technological and costly approaches discussed above with respect to the patents.

3. Solution to the Problem

The present invention solves the above-stated problem by providing a "one-of-a-kind" doll head that is custom-made to look just like the face of a particular child. Although the doll head is pre-manufactured, every doll head of the present invention is further hand crafted using ten facial characteristics to match the child's face shape, hair color, hair style, eyes, skin tone, etc., as described below. This combination of preproduction and hand crafting provides a doll head that is custom produced to match a particular child at a reasonable cost, in contrast to the American Girl and Baby So Beautiful dolls, in which large quantities of nearly identical dolls are mass produced in large quantities.

In the preferred embodiment, the customer, using the ten facial characteristics, chooses from a predetermined number of face shapes, skin tones, eye colors, eyelash colors, eyebrow thicknesses, shapes, and colors, and hair colors, cuts, styles, and lengths those characteristics that most closely match the child's features.

For example, to provide a doll that is closer to the actual physiognomy of the child than offered in the prior art, seven basic face shapes are utilized to provide a more realistic appearance. These shapes comprise rounded, oval, pear, rectangular, thinner rectangular, thinner heart, and wider heart face shapes. A doll head having the particular face shape chosen is obtained. The other characteristic features chosen are then attached or applied to the doll head. Thus, a doll head is constructed that more closely resembles the child's face than has previously been achievable, and at a more affordable cost than previous for such a unique doll.

SUMMARY OF THE INVENTION

The present invention provides a doll head that has the facial appearance of a particular child. The customer, using ten facial characteristics set forth in a chart, selects those most closely resembling the facial appearance of the child. Further details are provided by a color picture of the child. The selected characteristics are then applied to the doll head to produce a one-of-a-kind doll closely resembling the child.

The customer first selects a face shape from seven predetermined face shapes comprising rounded, oval, pear, rectangular, thinner rectangular, thinner heart, and wider heart shapes. In the alternative, the customer provides a representative photograph or photographs of the child, from which the appropriate face shape is determined by the manufacturer. These seven shapes were empirically determined to be the minimum set of representative face shapes for 95 percent of children in the 3- to 12-year-old range, irregardless of race. However, because there are distinctively different facial features for different children, in each of the seven categories of face shapes, the doll heads have different facial features, for example, noses are longer or shorter or narrower or wider, and/or eyes are narrow set or wide set. The customer further selects a skin tone from among five skin tones, an eye color from among fourteen eye colors, an eyelash color from among four eyelash colors, an eyebrow color from among eight eyebrow colors, an eyebrow thickness from among three eyebrow thicknesses, an eyebrow shape from among four eyebrow shapes, a hair color from among thirteen hair colors, a haircut from among three haircuts, a hair length from among six hair lengths, and a hair style from among nineteen hair styles. Finally, the customer indicates on a series of face views of a generic child any birthmarks, moles, and/or freckles that the particular child has.

Once the specific characteristics are determined, a doll head is selected that corresponds to the facial shape and skin tone chosen. This doll head is selected from an inventory of different doll heads having the seven predetermined facial shapes. The selected eyes, eyelashes, eyebrows, hair, and birthmarks, moles, and/or freckles are attached to or painted on the doll head. Any further details necessary are determined from the picture of the child. Thus, a one-of-a-kind doll is produced that closely resembles a particular child but can be made at a reasonable cost to the consumer.

BRIEF DESCRIPTION OF THE DRAWING

FIGS. 1*a* through 1*g* are schematic representations of various face shapes, with FIG. 1*a* being rounded, FIG. 1*b* being oval, FIG. 1*c* being pear-shaped, FIG. 1*d* being rectangular, FIG. 1*e* being thinner rectangular, FIG. 1*f* being thinner heart-shaped, and FIG. 1*g* being wider heart-shaped.

FIGS. 2*a* through 2*c* are schematic representations of various eyebrow shapes, with FIG. 2*a* being straight, FIG. 2*b* being slightly arched, and FIG. 2*c* being arched.

FIG. 4*a* shows a right profile view of a generic child's head, FIG. 4*b* shows a front view of a generic child's head, and FIG. 4*c* shows a left profile view of a generic child's head.

DETAILED DESCRIPTION OF THE INVENTION

1. Overview

Figure 3A:
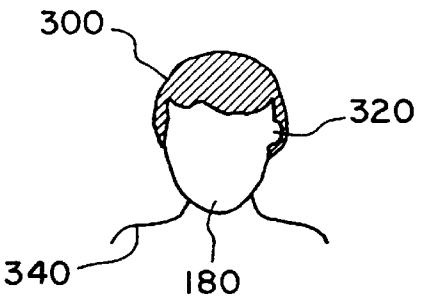
FIGS. 3*a* through 3*f* illustrate various hair lengths, with FIG. 3*a* being ear length, FIG. 3*b* being chin length, FIG. 3*c* being shoulder length, FIG. 3*d* being high back length, FIG. 3*e* being midback length, and FIG. 3*f* being lower back length.

The present invention provides a one-of-a-kind doll head that corresponds in appearance to the facial appearance of a particular child. Such doll heads can, of course, be made by an artist who sculpts the face of each doll to be identical to the face of the child. However, such a hand-made doll may well cost into the hundreds or thousands of dollars to obtain, depending on the reputation of the artist. This cost is prohibitive for the average parents (grandparents) who desire to have a doll or dolls similar in appearance to their child or children (grandchildren). The present invention sets forth a system and method for producing doll heads having the realistic, hand-crafted facial appearance of particular children at a reasonable cost.

The facial appearance of the doll head of the preferred embodiment is based on two forms of input: a picture or pictures of the face of a child and the completion of a ten-point facial characteristic chart. The input provided by the picture is discussed below. The ten-point facial characteristic chart provides the customer with ten broad categories of facial characteristics, that is, face shape, skin tone, eye color, eyelash color, eyebrow color, eyebrow thickness and shape, hair color, hair cut, hair length, hair style, and birthmarks/moles/freckles. Each category is further broken down into a predetermined number of, for example, skin tones or eyebrow colors. The combinations chosen by the customer are used to manufacture a doll head having an appearance closely resembling the facial appearance of the particular child. Each of the ten categories is described in more detail below, as are the steps necessary to manufacture the individualized doll.

2. Details a. Face Shape. The face shape of the child is selected from one of seven, in the preferred embodiment, face shapes shown in FIG. 1. These face shapes are categorized as follows:

TABLE 1

| FIGURE | FACE SHAPE NAME |
|---|---|
| 1a | Rounded |
| 1b | Oval |
| 1c | Pear |
| 1d | Rectangular |
| 1e | Thinner rectangular |
| 1f | Thinner heart |
| 1g | Wider heart |

To determine the desired children's faces to be represented by a predetermined number of face shapes, hundreds of pictures of children were analyzed to determine the face shape of each child. It was found that these hundreds of individual face shapes could be categorized into seven broad categories of face shapes that are the minimum set of representative face shapes for 95 percent of children in the 3- to 12-year-old range independent of race. The broad categories as listed in Table 1 and illustrated in FIGS. 1*a* through 1*g*, respectively, include rounded-, oval-, pear-, rectangular-, thinner rectangular-, thinner heart-, and wider heart-shaped faces. The available facial features have a range; for example, and not meant to be inclusive, eyes are narrower set versus wider set, noses are narrower versus wider, and lips are narrower versus wider.

A face has in general an elliptical shape. The seven face shapes of the present invention are achieved by varying the shapes of sections of the base elliptical shape with respect to other sections as follows. The base ellipse is divided into three sections: a top section 120 corresponding to the area above and including the eyebrows; a middle section 140 corresponding to the area between the eyebrows and the upper lip; and a bottom section 160 corresponding to the area below and including the upper lip. The chin 180 is also sometimes varied in shape. For example, in the rounded face shape shown in FIG. 1*a*, the middle section 140 is wider than the upper 120 and bottom 160 sections, while the upper 120 and bottom 160 sections are identical to each other in width. All three sections 120, 140, 160 have rounded sides. The same relative widths and rounded sides exist in the oval face shape shown in FIG. 1*b*; however, the overall widths of the three sections 120, 140, 160 in the rectangular face shape are less than the overall widths of the three sections 120, 140, 160 of the rounded face shape shown in FIG. 1*a*. In the pear-shaped face shown in FIG. 1*c*, the top section 120 is narrower than the middle section 140, and the middle section 140 is narrower than the bottom section 160, with the chin 180 also being widened. In contrast, to form the rectangular-shaped and thinner rectangular-shaped face shapes shown in FIGS. 1*d* and 1*e*, respectively, the three sections 120, 140, 160 have similar widths, but the middle section 140 has straight sides. The overall width of the thinner rectangular face shape is less than the overall width of the rectangular face shape. The thinner heart-shaped face shape illustrated in FIG. 1*f* and the wider heart-shaped face shown in FIG. 1*g* are obtained when the top section 120 is widest, the middle section 140 is less wide, and the bottom section 160 is the narrowest. The thinner heart-shaped face has an overall width less than the overall width of the wider heart-shaped face, and with a more sharply tapered chin 180.

After all face shapes are placed into the predetermined number of broad categories described above, actual doll heads corresponding to each face shape are made by a conventional vinyl molding process. It is to be understood that other materials and processes can be used to manufacture the doll heads as contemplated under the teachings of the present invention. For example, an artist can sculpt a bust of each representative child, or the heads may be made of a material other than vinyl.

This predetermined number of face shapes in FIG. 1 with corresponding doll heads provides a small number of different doll heads to maintain an inventory for and that can be utilized, under the teachings of the present invention, to more perfectly match the appearance of a child. Certainly, in other embodiments, more face shapes and facial characteristics could be utilized, which would increase the number and, therefore, the manufacturing costs. Fewer face shapes and facial characteristics could also be used, which would reduce the number and reduce the manufacturing costs but would not provide the uniqueness or "one-of-a-kind" appearance desired. The number of face shapes in the preferred series could range from five to nine under the teachings of the present invention.

b. Skin Tone. Under the teachings of the preferred embodiment and as found in the prior art of the trademarked MY TWINN doll is a selection of skin tones. In the preferred embodiment the following six skin tones are utilized: very fair, fair, olive, tan, brown, and dark brown. More or less than this number of skin tones could be utilized under the teachings of the present invention. Doll heads having the seven face shapes and corresponding doll limbs are premanufactured in each of the six skin tones. The coloration of each face and set of limbs is then customized by applying a fine "blush" or rosiness with an airbrush, or by another conventional method. In this way each particular doll's skin tone is accented to bring out, for example, more pink or more beige, or to make the skin tone look slightly lighter or slightly darker overall. The blushing process is performed after the vinyl manufacturing and before final assembly of the doll. By this technique of applying "blush," the finished doll head becomes even closer in appearance to that of a particular child.

c. Eye color. Under the teachings of the preferred embodiment and as found in the prior art of the trademarked MY TWINN doll is a selection of eye colors to resemble that of the particular child. Fourteen eye color choices are available in the preferred embodiment, ranging from light blue through green to hazel to dark brown. More or less than this number of eye colors could be utilized under the teachings of the present invention. Eyes having the selected color are inserted into the selected doll's head during the manufacturing process.

d. Eyelash Color. Under the teachings of the present invention, the color of the eyelash is important and four selections are possible: blond, golden brown, dark brown, and black. Eyelashes of the selected color are inserted into the selected doll's head above the eyes.

e. Eyebrow Color. The color of the eyebrow 200 may differ from that of the eyelash and/or hair. It is a feature of the present invention to provide a selection of eyelash, hair, and eyebrow colors so that the resulting doll will more closely resemble the appearance of the particular child. A greater selection of eyebrow colors are provided under the teaching of the present invention than eyelash colors. In the preferred embodiment thirteen eyebrow colors are provided: pale blond, blond, ash blond, dark blond, strawberry blond, red, auburn, golden brown, brown, medium brown, dark brown, brown/black, and black.

f. Eyebrows. Both the thickness and the shape of the eyebrow 200 are critical to obtain the hand-crafted unique appearance of the doll head. With respect to thickness, the present invention, in the preferred embodiment, permits the selection of thin, moderate, or full eyebrows. The shapes of the eyebrows are shown in FIG. 2. The eyebrow is thicker at the end 220 proximal to the eye and tapered at the end 260 distal to the eye. The shape of the middle 240 of the eyebrow 200 extending between the proximal end 220 and distal end 260 can be straight (FIG. 2*a*), slightly arched (FIG. 2*b*), or arched (FIG. 2*c*). If the eyebrow of the particular child does not match the shapes provided, the desired shape can be drawn in the facial characteristics chart (not shown). Eyebrows of the selected color, thickness, and shape are applied to the head of the selected doll above the eyes during the manufacturing process, for example, by painting.

g. Hair color. The hair color is an important characteristic of the child and must also be an important characteristic of the doll. The hair 300 becomes the predominant portion of the doll's upper extremities, especially when viewed from the back and the sides. Hence, under the teachings of the present invention, a large number of selected hair colors is available. The following thirteen colors are utilized: pale blond, blond, ash blond, dark blond, strawberry blond, red, auburn, golden brown, brown, medium brown, dark brown, brown/black, and black. This substantially corresponds to the prior art hair colors of the trademarked MY TWINN doll wherein ten colors of pale blond, strawberry blond, ash blond, regular blond, light ginger, auburn, golden brown copper, light golden brown, light brown, and dark brown are utilized.

It is a feature of the present invention to provide greater selection in the hair color and in the eyebrow color than in the eyelash color.

h. Haircut. The haircut for the selected hair can be: all of one length, tapered in appearance, or layered in appearance.

i. Hair length. As shown in FIGS. 3*a* through 3*f*, in the preferred embodiment, six lengths of hair are utilized:

TABLE 2

| FIGURE | HAIR LENGTH |
|---|---|
| 3a | Ear length |
| 3b | Chin length |
| 3c | Shoulder length |
| 3d | High back length |
| 3e | Midback length |
| 3f | Lower back length |

Figure 3B:
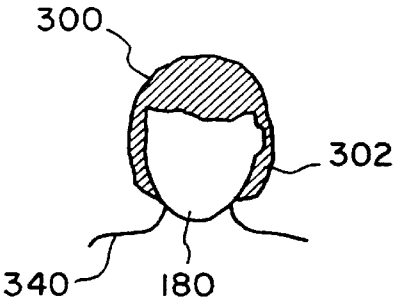
Figure 3C:
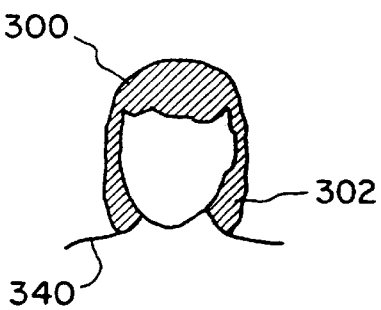
Figure 3D:
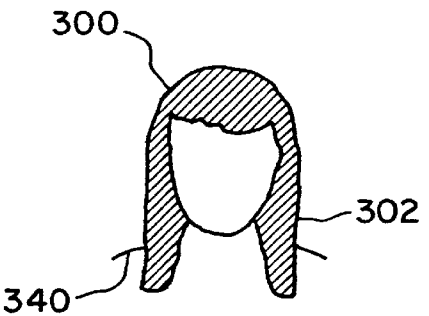
Figure 3E:
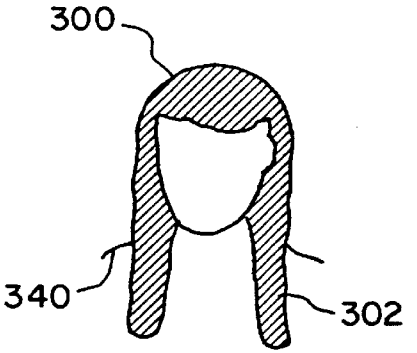
Figure 3F:
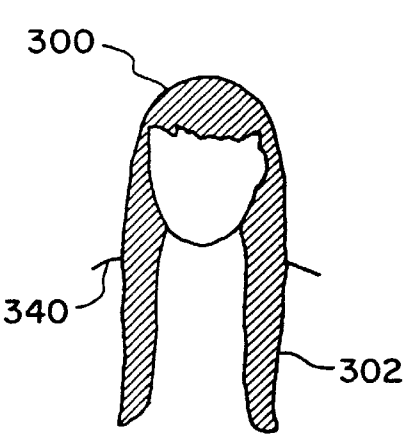

Ear length hair extends to the level of the ear 320 as shown in FIG. 3*a*. As the hair 300 grows, the ends 302 of the hair 300 reach further down the head and torso. Chin-length hair extends to the level of the chin 180 as illustrated in FIG. 3*b*. Shoulder-length hair extends to the level of the top of the shoulder, as shown in FIG. 3*c*. As the hair 300 grows further, the ends 302 may reach the upper back, midback, and lower back, as shown in FIGS. 3*d*, 3*e*, and 3*f*, respectively.

j. Hair style. In the stylization of the hair it is important to determine whether the hair style has bangs, what the style is, and if there is a part in the hair.

With respect to the bangs, a determination or a selection is made as to: straight, very curly, slightly curled under, layered, wispy, or no bangs. With respect to the style, the following style selections are made: bone straight, straight with a little wave, wavy (permed), loose curls all over, tight curls all over, ends curled up, ends curled under, pulled back, and pulled up. With respect to the hair part, the following selections are made: child's left side, center, child's right side, and none. A total of nineteen choices are available with respect to hair style.

When a hair color, cut, length, and style have been selected to correspond to that of the particular child whom the doll is to resemble, the hair 300 is attached to the head of the doll.

k. Birthmarks-moles-freckles. In FIGS. 4*a*, 4*b*, and 4*c* a generic child's head 400 is shown. FIG. 4*a* illustrates a right profile 420; FIG. 4*b* illustrates the full face 440; and FIG. 4*c* shows the left profile 460. By using a pen, for example, marks can be made on the face 440 or on the profiles 420, 460 where the child has freckles 480, birthmarks 485, and/or moles 490. The prior art trademarked MY TWINN product has a profile similar to FIG. 4*b* that allows freckles to be drawn on.

It can be readily observed that under the selection process set forth above more than 1.5 billion potential combinations are obtainable. This is derived as follows (not including the range of facial characteristics, freckles, birthmarks, moles, or specialized skin tone blush application):

7 face shapes×6 skin tones×14 eye colors×4 eyelash colors×13 eyebrow colors×3 eyebrow thicknesses×4 eyebrow shapes×13 hair colors×3 haircuts×6 hair lengths×19 hair styles=1,631,290,752

Figure 5:
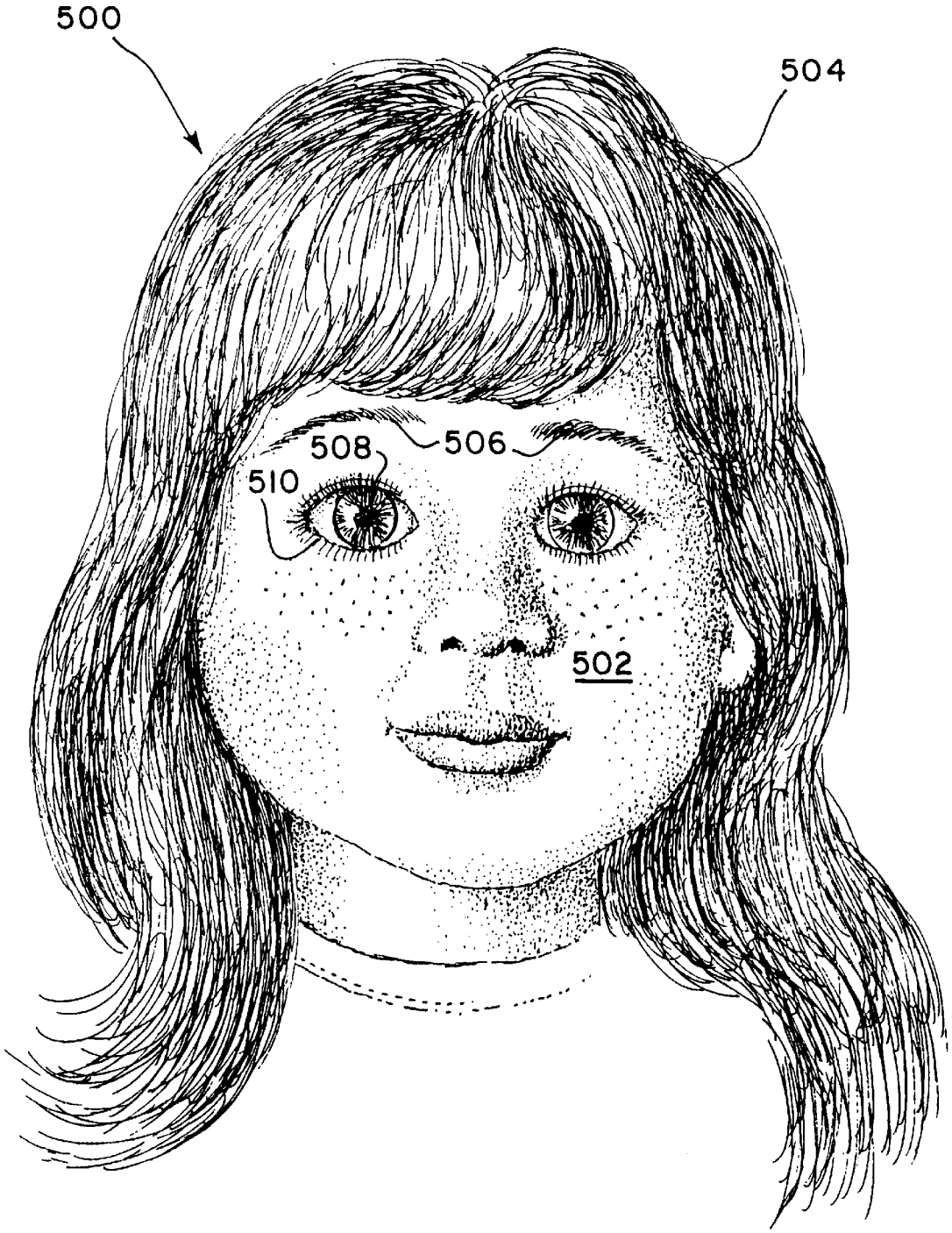
FIG. 5 is a photograph of a frontal view of a realistic doll head under the teachings of the present invention.

Nose and lip configurations corresponding to the particular facial features of the child are also utilized as described above. The need for these features is determined from the picture of the child. The picture also provides details about hair style that are applied to the hair on the doll head. A completed preproduced, yet having a hand-crafted realistic appearance, doll with a doll head 500 of the present invention is illustrated in FIG. 5. The doll head shown in FIG. 5 has a pear-shaped face 502, auburn hair 504 and eyebrows 506, straight eyebrows 506, hazel eyes 508, golden brown eyelashes 510, midback length hair that is straight with a little wave, slightly curled under bangs, and a left part, and fair skin tone with freckles.

3. Manufacturing Process

To provide a one-of-a-kind doll head having facial features resembling those of a particular child, yet at a reasonable cost, doll heads according to the present invention are in part preproduced and in part hand crafted.

Above was described the process by which a predetermined number of face shapes were discovered. In the preferred embodiment, seven face shapes are used: rounded, oval, pear, rectangular, thinner rectangular, thinner heart, and wider heart. Only seven types of doll heads corresponding to each face shape are preproduced.

To even more closely match a particular child, the present invention teaches that a portion of the preproduced doll heads are also manufactured with a range of preproduced facial features; for example, eyes are narrower set versus wider set, noses are narrower versus wider and longer versus shorter, and lips and mouths are narrower versus wider.

In an alternative embodiment, the customer provides one or more representative photographs, preferably in color, of the particular child. The manufacturer then selects the appropriate face shape on the basis of the supplied photograph(s).

On the basis of the information provided by the customer in the ten-point facial characteristic chart, a doll head corresponding to the selected face shape and skin tone is obtained from the inventory prepared by pre-manufacturing. A photograph of the child is also used to verify that the correct face shape has been selected. At this point the particular features desired are hand crafted onto the doll head as follows. The selected doll head is further custom colored with "blush" to more closely match the skin tone of the particular child, based on the photograph of the child. Eyes having the color selected are inserted into molded eye sockets, and eyelashes of the selected color are inserted into the eyelids above the eyes. Eyebrows corresponding to the color, thickness, and shape indicated on the facial characteristic chart are applied to the doll head above the eyes. In the preferred embodiment, the eyebrows are painted on the doll head. Hair of the color, cut, length, and style selected is then attached to the doll head. Again, a photograph of the child is used under the teachings of the present invention to tweak the hair style so that it more closely resembles that of the particular child. Finally, birthmarks, freckles, and/or moles, if any, are applied to the face of the doll head, for example, by hand painting.

4. On-Line Ordering

A customer can order a doll by filling out a printed copy of the ten-point facial characteristic chart and mailing it to the manufacturer. In another embodiment contemplated under the teachings of the present invention, the customer can order a doll by using an on-line computer to send the pertinent information directly to the manufacturer. In this embodiment, the customer contacts the manufacturer via a modem attached to the customer's computer. This can be done directly or through any conventional on-line shopping service, Internet address, or World-Wide Web home page. The ten-point facial characteristic chart is displayed on the customer's monitor, and the customer then uses a mouse or the keyboard to select the desired combination of facial characteristics. For example, using a mouse, the customer can move the cursor to a particular face shape and click on the mouse to select that face shape. The remaining choices are similarly made by the customer.

The invention has been described with reference to the preferred embodiment. Modifications and alterations will occur to others upon a reading and understanding of this specification. It is intended to include all such modifications and alterations insofar as they come within the scope of the appended claims or the equivalents thereof.

We claim:

1. In a method of ordering and manufacturing a doll head having the facial appearance of a particular child, of the type wherein said doll head is ordered by selecting from an order form an eye color, a hair color, a hair length, and a skin color, and wherein said doll head is manufactured by attaching eyes of said selected eye color, hair of said selected hair color and said selected hair length to said doll head of said selected skin tone, the improvement comprising the steps of:

ordering said doll head by:

(a) selecting from said order form a face shape from the group consisting of rounded, oval, pear, rectangular, thinner rectangular, thinner heart, and wider heart, said selected face shape corresponding to the face shape of said particular child;

(b) selecting from said order form an eyelash color from four predetermined eyelash colors, said selected eyelash color corresponding to the eyelash color of said particular child;

(c) selecting from said order form an eyebrow color from thirteen predetermined eyebrow colors, said eyebrow color corresponding to the eyebrow color of said particular child;

(d) selecting from said order form an eyebrow thickness from three predetermined eyebrow thicknesses, said predetermined eyebrow thickness corresponding to the eyebrow thickness of said particular child;

(e) selecting from said order form an eyebrow shape from three predetermined eyebrow shapes, said eyebrow shape corresponding to the eyebrow shape of said particular child;

(f) selecting from said order form a haircut from three predetermined haircuts, said selected haircut corresponding to the haircut of said particular child;

(g) selecting from said order form a hair style from six bang selections, four part selections, and nine style selections, said selected hair style corresponding to the hair style of said particular child;

(h) selecting from said order form said hair length from six predetermined hair lengths, said selected hair length corresponding to the hair length of said particular child;

(i) selecting from said order form said skin tone from six predetermined skin tones, said selected skin tone corresponding to the skin tone of said particular child;

(j) selecting from said order form said eye color from fourteen predetermined eye colors, said selected eye color corresponding to the eye color of said particular child;

(k) selecting from said order form said hair color from thirteen predetermined hair colors, said selected hair color corresponding to the hair color of said particular child; and manufacturing said doll head by:

(a) selecting a doll head corresponding to said selected face shape and said selected skin tone;

(b) applying a fine blush to customize the coloration of said doll head;

(c) inserting eyes corresponding to said selected eye color into said selected doll head;

(d) inserting eyelashes corresponding to said selected eyelash color into said selected doll head;

(e) painting eyebrows corresponding to said selected eyebrow color, said selected eyebrow thickness, and said selected eyebrow shape onto said selected doll head; and (f) attaching hair corresponding to said selected hair color, said selected haircut, said selected hair length, and said selected hair style onto said selected doll head.

2. The method of claim 1 wherein the step of ordering said doll head is on-line over the Internet.

* * * * *